United States Patent [19]

Takeda

[11] Patent Number: 4,756,969

[45] Date of Patent: Jul. 12, 1988

[54] HIGHLY ELECTRICALLY CONDUCTIVE FILAMENT AND A PROCESS FOR PREPARATION THEREOF

[75] Inventor: Toshiyuki Takeda, Nagoya, Japan

[73] Assignee: Toray Industries, Inc., Tokyo, Japan

[21] Appl. No.: 64,839

[22] Filed: Jun. 19, 1987

Related U.S. Application Data

[63] Continuation-in-part of Ser. No. 801,097, Nov. 22, 1985, abandoned.

[30] Foreign Application Priority Data

Nov. 28, 1984 [JP] Japan ..... 59-249713

[51] Int. Cl.[4] ..... D02G 3/00

[52] U.S. Cl. ..... 428/372; 428/373; 428/375; 428/392; 428/394; 428/395; 428/397; 428/400; 264/171; 264/177.1

[58] Field of Search ..... 428/372, 373, 375, 394, 428/395, 397, 400; 264/171, 177.1

[56] References Cited

U.S. PATENT DOCUMENTS

| | | | |
|---|---|---|---|
| 2,932,079 | 4/1960 | Dietzsch et al. | 428/397 |
| 3,803,453 | 4/1974 | Hull | 428/375 |
| 3,969,559 | 7/1976 | Boe | 428/372 |
| 4,061,827 | 12/1977 | Gould | 428/372 |
| 4,129,677 | 12/1978 | Boe | 428/372 |
| 4,207,376 | 6/1980 | Nagayasu et al. | 428/367 |
| 4,216,264 | 8/1980 | Naruse et al. | 428/397 |
| 4,255,487 | 3/1981 | Sanders | 428/368 |
| 4,388,370 | 6/1983 | Ellis et al. | 428/368 |

FOREIGN PATENT DOCUMENTS

| | | |
|---|---|---|
| 25647 | 5/1982 | Japan . |
| 2036638 | 7/1980 | United Kingdom . |

OTHER PUBLICATIONS

Chemical Abstracts, vol. 94, 1981, p. 71, 94:32066h: Bicomponent Synthetic Fiber Antistatic Agents.

Chemical Abstracts, vol. 94, 1981, p. 81, 176598f, Electroconductive Synthetic Fibers.

Chemical Abstracts, vol. 91, 1979, p. 68, 40834k, Electroconductive Polyamide Fibers.

Chemical Abstracts, vol. 92, 1980, pp. 61–62, 95542q: Antistatic Synthetic Fibers.

Chemical Abstracts, vol. 94, 1981, p. 81, 8558m, Antistatic Nylon Fibers.

*Primary Examiner*—Sharon A. Gibson

*Attorney, Agent, or Firm*—Austin R. Miller

[57] ABSTRACT

A highly electrically conductive composite filament of sheath-core type, comprising core and sheath layers of an electrically non-conductive thermoplastic polymer and a middle layer of electrically conductive thermoplastic polymer containing carbon black between the core and sheath wherein said sheath partially surrounds the outer periphery of said middle layer.

11 Claims, 1 Drawing Sheet

HIGHLY ELECTRICALLY CONDUCTIVE FILAMENT AND A PROCESS FOR PREPARATION THEREOF

RELATED APPLICATION

This is a continuation-in-part of our U.S. application Ser. No. 801,097, filed Nov. 22, 1985 now abandoned.

BACKGROUND OF THE INVENTION (1) Field of the Invention

This invention relates to a sheath-core composite filament having highly electrically conductive properties, and to a process for the preparation thereof.

(2) Description of the Prior Art

Composite filaments are known comprising as one component an electrically conductive thermoplastic synthetic polymer including electrically conductive carbon black. These have been used widely as basic materials for imparting antistatic capability to fiber products such as carpets and garments.

Known typical composite forms are: the two-layer sheath-core type (U.S. Pat. No. 3,803,453) with an electrically conductive layer as the core and an electrically non-conductive layer as the sheath; the three-layer sheath-core type (U.S. Pat. No. 4,207,376) with an electrically conductive layer as the middle layer surrounded completely by an electrically non-conductive layer; the partially encapsulated side-by-side conjugate type (U.S. Pat. No. 3,969,559) in which an electrically non-conductive layer encapsulates partially an electrically conductive layer; the side-by-side simple conjugate type (U.S. Pat. No. 4,129,677) in which an electrically conductive layer extends along the periphery of the filament and the interface formed by the non-conductive layer and the conductive layer is convex/concave; and, the two-layer reverse sheath-core type (Japanese Patent Publication No. 82/25647) with an electrically conductive layer as the sheath and an electrically non-conductive layer as the core.

Composite filaments of the two-layer sheath-core type or the three-layer sheath-core type as above-mentioned are useful antistatic materials for use in fiber products, being widely used in antistatic carpets and antistatic garments, because they have good yarn forming properties in that the electrically conductive layer is not exposed on the filament surface and presents no problem of fibrillation due to composite interface peeling.

However, in a composite filament having an electrically conductive layer surrounded completely by an electrically non-conductive layer, such as a filament of the two-layer sheath-core type or the three-layer sheath-core type as above-mentioned, the level of surface electrical resistivity of which is about $10^{10}$ to $10^{11}$ Ω, is unsuitable for use in static control and contamination control garments for clean rooms, which require a high surface electrical conductivity of about $10^6$ to $10^7$ Ω. Therefore, static control and contamination control garments employ a coating type electrically conductive filament in which the filament is coated with an electrically conductive resin including electrically conductive carbon black. However, such coating type electrically conductive filaments are disadvantageously uneven in thickness due to the coating, and are poor in weaving properties. Therefore, a need exists for a composite filament having a high electrical conductivity equivalent to that possessed by the coating type filament.

In the preparation of the foregoing partially encapsulated side-by-side conjugate type composite filament, which has an electrically conductive layer exposed on the filament surface and is manufactured by the side-by-side composite process, two components which are extremely different in melt viscosity must be conjugated side-by-side in order that the electrically conductive component of high viscosity is partially encapsulated by the electrically non-conductive component of low viscosity. Therefore, in order to minimize the scatter of composite forms and keep the proportion of exposure of the electrically conductive layer constant, it is necessary to control strictly the melt viscosities of both components. As a result, the filament is disadvantageously difficult in industrial production.

The foregoing side-by-side simple conjugate type composite filament has also further disadvantages in that the interface formed by the non-conductive layer and the conductive layer is extremely easy to peel off, and the filament is readily fibrillated during use. Therefore, the filament is unsuitable for use in static garments for clean rooms.

In addition, the foregoing two-layer reverse sheath-core type composite filament involves several problems. Since carbon black of high concentration is present all over in the filament surface layer, carbon black readily falls out during the production processes, resulting in extensively stained production apparatus, and the filament per se is black in color reflecting no light, whereby it cannot be seen with the naked eye. Therefore, such filament is very difficult to produce industrially; in fact, no filament of this type is manufactured in the industry.

Any of the stated conventional type composite filaments in which an electrically conductive layer is exposed on the filament surface, involves problems in yarn formation or yarn quality and is unsatisfactory for industrial production.

SUMMARY OF THE INVENTION

It is a primary object of the present invention to overcome the foregoing problems involved in the conventional highly electrically conductive filaments, and to provide a highly electrically conductive composite filament which is excellent in electrical conductivity, which has good yarn forming properties and presents no problems in degrading in electrical conductivity due to falling out of electrically conductive carbon black, and fibrillation.

Another object of this invention is to provide a highly electrically conductive composite filament which is easy to composite-spin and has good composite form, and a process for the preparation thereof.

DETAILED DESCRIPTION OF THE PREFERRED EMBODIMENT

This invention will now be described in detail by reference to embodiments illustrated in the accompanying drawings.

Figure 1:
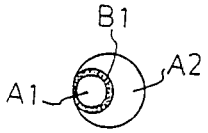
FIG. 1 is a diagram illustrating the cross-section of one embodiment of composite filament according to this invention.

Referring to FIG. 1 showing the cross-section of one embodiment of the composite filament according to this invention, the highly electrically conductive filament of the invention is of the sheath-core type, and comprises core and sheath layers constituting an electrically non-conductive thermoplastic synthetic polymer and a middle layer constituting an electrically conductive thermoplastic synthetic polymer containing 15 to 50 percent by weight electrically conductive carbon black; said core layer comprises 10–50 percent of the filament cross-sectional area, said middle layer surrounds the overall periphery of said core layer, and said sheath layer partially surrounds the outer periphery of said middle layer, 20–45 percent of which is exposed on the filament surface.

The present composite filament has a novel composite form, the preparation of which is made possible only by a modified sheath-core composite process unprecedented in any of the conventional processes of producing the stated conventional type filament having an electrically conductive layer exposed.

The thermoplastic synthetic polymer (hereinafter referred to as electrically non-conductive polymer (A)) constituting the core layer (A1) and the sheath layer (A2) in the present highly electrically conductive composite filament, includes synthetic thermoplastic fiber-forming polymers, for example, polyamides, polyesters or polyolefins. Among them, polyamides such as nylon 6 and nylon 66, and polyesters such as polyethylene-terephthalate and polybutylene-terephthalate are used preferably. The electrically non-conductive polymer (A) may be used in combination with antistatic agents such as polyalkylene-glycol, polyalkylenether-glycol, polyetheramide, N-alkyl-polyamide, and derivatives thereof, along with fiber additives in common use. In order to eliminate the black color of the filament, it is effective to mix a delustrant such as titanium oxide in the electrically non-conductive polymer (A), especially in the sheath layer (A2).

In order to simplify the composite spinneret, the core layer (A1) and the sheath layer (A2) are constituted of the same kind of electrically non-conductive polymer (A).

On the other hand, the thermoplastic synthetic polymer (base polymer) constituting the middle layer (B1) employs a polymer similar to the above-mentioned polymer as the electrically non-conductive polymer (A).

The electrically conductive carbon black uniformly dispersed in the middle layer (B1) may be conventional, and its compounding proportion must be from 15 to 50 percent by weight of the base polymer constituting the middle layer (B1). If the proportion is too low, the electrical conductivity is poor, and if too high, the yarn forming properties degrade. The carbon black compounding proportion is preferably from 30 to 40 percent.

In this invention, the highly electrically conductive filament may be prepared by the process which comprises dividing a molten, fiber-forming electrically non-conductive synthetic polymer into two parts, that is a core component stream and a sheath component stream, in a spinneret pack, feeding a molten electrically conductive component from every direction around said core component stream to form a two-layer sheath-core composite stream, feeding said sheath component stream from partially around said composite stream to form a three-layer composite stream, and melt spinning said three-layer composite stream by extrusion from the spinneret.

Figure 2:
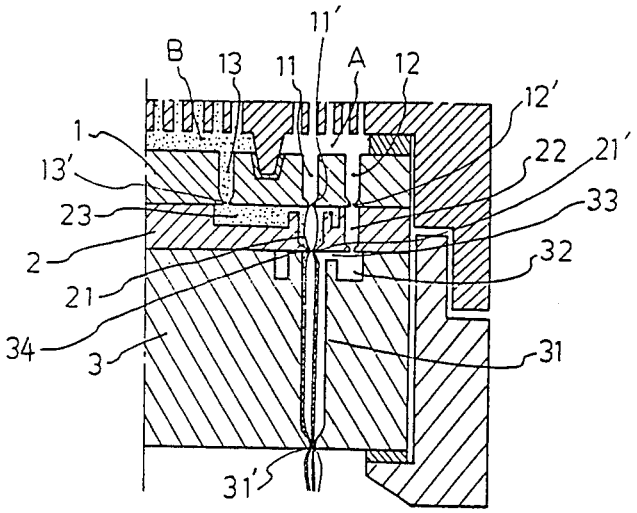
FIG. 2 is a partial cross-sectional diagram illustrating a spinning condition with a composite spinneret incorporated in a spinneret pack according to this invention.

The composite spinneret shown in FIGS. 2 and comprises three parts, that is an upper part (1), a middle part (2) and a lower part (3) of the spinneret.

A molten electrically non-conductive polymer (A) and a molten electrically conductive polymer (B) flow into separate polymer feed zones above the spinneret after having been melted and filtered.

The electrically non-conductive polymer (A) flows into outside feed holes (11 and 12 of the upper part (1) of the spinneret and further flows into the middle part (2) of the spinneret while being metered at the metering holes (11′ and 12′), respectively. Two-layer composite holes (21) are formed just below the one feed hole (11) of the outside feed holes, and a flow down hole (22) just below the other outside feed hole (12).

On the other hand, electrically conductive polymer (B) flows into an inside feed hole (13) of the upper part (1) of the spinneret and further flows into the middle part (2) of the spinneret while being metered at the metering hole (13′), after which it flows into the two-layer composite holes (21) following a flow path (23) in the middle part (2) of the spinneret.

In the two-layer composite holes (21), the electrically conductive polymer (B) surrounds the periphery of the electrically non-conductive polymer (A) to form a two-layer sheath-core composite stream, which flows past the metering holes (21′) into a three-layer composite hole (31) in the lower part (3) of the spinneret. In the three-layer composite hole (31), the two-layer sheath-core composite stream is partially surrounded by the electrically non-conductive polymer (A2) (FIG. 1) which has reached the three-layer composite hole (31) through the outside feed holes (12), the flow down hole (22), and a flow path (32) of the lower part (3) of the spinneret, forming a three-layer composite stream.

Figure 3:
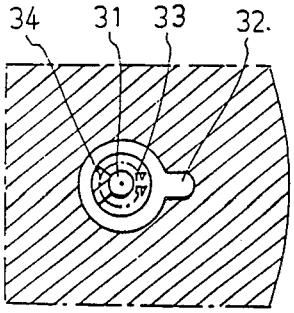
FIG. 3 is a plan view of the lower part (3) of the said spinneret.

The composite form (shown in FIG. 1), in which the sheath layer (A2) partially surrounds the outer periphery of the middle layer (B1), may be formed (as shown in FIGS. 2 and 3) by partially closing the passage through which the electrically non-conductive polymer (A2) is fed into the three-layer composite holes (31); and by approximately increasing the degree of eccentricity of the extrusion hole of the two-layer composite hole (21) with respect to the three-layer composite hole (31); or a combination of the above-mentioned methods. Among these the combination method is most preferable.

Figure 4A:
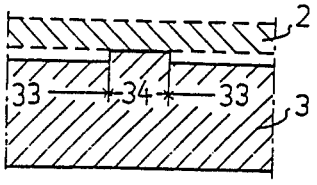
FIG. 4 (*a*) is a diagram of the cross-section along the curve IV—IV in FIG. 3, and FIG. 4 (*b*) is a cross-sectional diagram illustrating another embodiment.
Figure 4B:
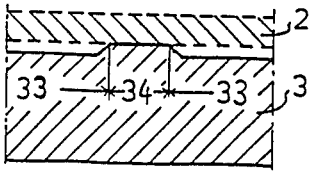

In FIGS. 2 and 3, the electrically non-conductive polymer (A) flows into the three-layer composite hole (31) while being controlled by the constriction (33). Further, part (34) of the constriction (33) is raised to almost the same level as the upper surface of the lower part (3) of the spinneret to form a closed portion (34), by which the electrically non-conductive polymer (A) is blocked from flowing. Therefore, no electrically non-conductive polymer (A) comes from the direction of said closed portion (34), as a result of which no sheath layer is formed on the side beneath the closed portion (34). Thus, a composite form having the middle layer (B1) partially exposed on the filament surface is obtained. The amount of exposure of the middle layer can be varied by changing the angle of the closed portion (34) to the constriction (33), which is open all around, other than the closed portion (34). The angle of the closed portion may be between 20 and 180 degrees, preferably between 40 and 160 degrees on the central angle $\theta$. The border between the closed portion (34) and the constriction (33) may be like a step as shown in FIG. 4(*a*), or tapered as shown in FIG. 4(*b*), illustrating the cross-section along the lines IV—IV of the central circle.

The three-layer composite stream thus formed in the three layer composite hole (31) is spun from the extrusion hole (31) and formed into a filamentary yarn through customary formation steps such as cooling, lubrication, taking out, and drawing. After drawing, heat treatment and twisting may be employed according to necessity.

In this yarn forming process, the electrically non-conductive polymer (A) constituting the sheath and core layers (A1) and (A2) is oriented and crystallized in order to obtain appropriate mechanical properties necessary for use as a filament.

The highly electrically conductive composite filament of this invention is mainly characterized as follows: The proportion of cross-sectional area of the core layer is 10–50% of the total filament cross-sectional area, and the middle layer is exposed on the filament surface in a proportion of 20–45 percent. If the proportion of cross-sectional area of the core layer is too small, the benefits of the three-layer structure, such as the improvement of yarn forming properties and mechanical characteristics, are not achieved sufficiently. Although electrical conductivity is upgraded by the exposed middle layer, if the proportion of exposure of the middle layer is too high, the yarn forming properties degrade and undesirable fibrillation results. In practice, the proportion of exposure of the middle layer is preferably between 30 and 40 percent, and the proportion of cross-sectional area of the core layer is preferably between 20 and 45 percent of the total filament cross-sectional area.

The ratio of the electrically non-conductive layer (core layer and sheath layer to electrically conductive layer (middle layer) is preferably between 98:2 and 70:30, and that of the core layer to the sheath layer is preferably between 5:95 and 65:35.

The cross-sectional shape of the middle layer is preferably round as shown in FIG. 1, but may be irregular such as oval and semicircular.

The highly electrically conductive composite filament of this invention is effective for applications requiring high electrical conductivity, such as carpets for computer rooms, articles for computer-relating, static control and contamination control garments for clean rooms, explosion-free garments, mesh screens for video or visual display terminals, printing, food packaging and filtering.

Although for use in a mesh screen the cross-sectional shape of the filament is preferably round, in other uses it may be determined according to end use.

Filamentary yarns made with conductive filament of this invention may be woven or knitted into fabrics or garments such as the above-mentioned garments, for example. The fabrics may be woven or knitted usually, for example, by plain weave, by twill weave such as herringbone weave, etc. The filamentary yarn comprising the conductive filament may be spaced apart in the warp direction and/or the weft direction, and preferably exposed at the surfaces of the fabrics.

Carpets may be made up using as the face yarn filamentary yarns with the conductive filament of this invention.

A mesh screen may be made up using the conductive monofilament of this invention, in the usual manner.

The effects of this invention will now be described in detail by reference to the following Examples that by no means limit the scope of this invention.

EXAMPLE 1

Chipped nylon-6 (containing 0.4% by weight of titanium oxide) having a relative viscosity of 2.63 as measured in sulfuric acid was used as the electrically non-conductive component A, and the above-mentioned chipped nylon-6 containing 35% by weight of electrically conductive carbon black was used as the electrically conductive component B. The former polymer and the latter polymer were melted at 290° C. respectively. The melts were filtered through a White Alundum filter layer, introduced to a spinneret pack as shown in FIG. 2 and FIG. 3, wherein the central angle in the closed portion of the spinneret was 80 degrees, and were composite-spun.

The volume ratio of the non-conductive core layer/the conductive middle layer/the non-conductive sheath layer in the spun filament, was adjusted to 20/15/65 or 25/10/65.

The obtained undrawn spun filaments were wound up at a speed of 700 m/min. Then the spun filaments were heat-drawn at a temperature of 170° C. and a draw rate of 3.40.

The obtained conductive filamentary yarns were spun and drawn easily, without any trouble.

The physical properties of the obtained electrically conductive filamentary yarns were measured to obtain the results shown in Table 1.

TABLE 1

Physical properties of electrically conductive filamentary yarns of this invention

| | Sample No. 1 | Sample No. 2 |
|---|---|---|
| Component ratio of core/middle/sheath | 20/15/65 | 25/10/65 |
| Exposure area of conductive layer | 30% | 33% |
| Fineness | 25.1 D(3F) | 25.0 D(3F) |
| Strength | 2.1 g/d | 2.4 g/d |
| Elongation | 53% | 50% |
| Specific electrical resistivity | 57 Ω-cm | 130 Ω-cm |

The specific electrical resistivity was determined according to the following method.

A sample made up into a bundle as 1,000 denier was degreased by carbon tetrachloride and cut into a length of 10 cm. An electrically conductive resin was coated on both ends of the cut sample and was used as an electrode. At a temperature of 20° C., and a relative humidity of 65%, a direct current of 100 volts was applied to the electrode and the resistance was measured. The specific resistivity (Ω-cm) was calculated from the measured value of the resistance.

EXAMPLE 2

Chipped polyethyleneterephthalate (containing 2.5% by weight of titanium oxide) having an inherent viscosity of 0.65 as measured in sulfuric acid was used as the electrically non-conductive layer component A, and chipped nylon-6 containing 35% by weight of electrically conductive carbon black, which was used as the electrically conductive component B in the Example 1, was used as the electrically conductive layer component B. The former polymer and the latter polymer were melted at 290° C. respectively. The melts were filtered through a White Alundum filter layer and introduced to a spinneret pack as shown in FIG. 2 and FIG. 3, wherein the central angle in the closed portion of the spinneret was 80 degrees. They were composite-spun.

The volume ratio of the non-conductive core layer/-the conductive middle layer/the non-conductive sheath layer in the spun filament was adjusted to 25/15/60 or 20/20/60.

The obtained undrawn spun filaments were wound up at a speed of 900 m/min. And then, this filament was heat-drawn at a temperature of 155° C. and a draw ratio of 3.45. The obtained conductive filamentary yarns were spun and drawn easily, without any trouble.

The physical properties of the obtained electrically conductive filamentary yarns were measured to obtain the results shown in Table 2.

TABLE 2

| | Physical properties of electrically conductive filamentary yarns of this invention | |
|---|---|---|
| | Sample No. 3 | Sample No. 4 |
| Component ratio of core/middle/sheath | 25/15/60 | 20/20/60 |
| Exposure area of conductive layer | 35% | 35% |
| Fineness | 20.2 D(3F) | 20.3 D(3F) |
| Strength | 2.7 g/d | 2.6 g/d |
| Elongation | 44% | 53% |
| Specific electrical resistivity | 490 Ω-cm | 310 Ω-cm |

EXAMPLE 3

The electrically non-conductive component A and the electrically conductive component B were the same components as used in Example 1, respectively. Composite spinning was carried out in the same manner as described in Example 1, to prepare a monofilament having the volume ratio of core/middle/sheath of 25/10/65, and a monofilament having a volume ratio of core/middle/sheath of 20/15/65.

The obtained undrawn spun filament was wound up at a speed of 900 m/min. Then the spun filament was heat-drawn at a temperature of 170° C. and a draw rate of 3.30. The obtained conductive filamentary yarns were spun and drawn easily, without any trouble.

The physical properties of the obtained electrically conductive filamentary yarns were measured to obtain the results shown in Table 3.

TABLE 3

| | Physical properties of electrically conductive monofilamentary yarns of this invention | |
|---|---|---|
| | Sample No. 5 | Sample No. 6 |
| Component ratio of core/middle/sheath | 20/15/65 | 25/10/65 |
| Exposure area of conductive layer | 30% | 35% |
| Fineness | 9.8 D(1F) | 9.7 D(1F) |
| Strength | 2.3 g/d | 2.5 g/d |
| Elongation | 43% | 40% |
| Specific electrical resistivity | 140 Ω-cm | 200 Ω-cm |

TABLE 3-continued

| | Physical properties of electrically conductive monofilamentary yarns of this invention | |
|---|---|---|
| | Sample No. 5 | Sample No. 6 |
| resistivity | | |

COMPARATIVE EXAMPLES

Chipped nylon-6 (containing 0.4% by weight of titanium oxide) having a relative viscosity of 2.63 as measured in sulfuric acid was used as the non-conductive layer component A, and the above-mentioned chipped nylon-6 containing 35% by weight of electrically conductive carbon black was used as the conductive layer component B. The former polymer and the latter polymer were melted at 290° C. respectively. The melts were filtered, introduced to a spinneret pack, and composite-spun to prepare a co-axial sheath-core three-layer composite filament, consisting of a non-conductive core layer, a conductive middle layer and non-conductive sheath layer, as a comparative filament No. 1.

The volume ratio of core/middle/sheath in comparative filament No. 1 was adjusted to 10/5/85. The obtained undrawn spun filaments were wound up at a speed of 800 m/min. Then, the filaments were heat-drawn at a temperature of 170° C. and a draw ratio of 3.03. On the other hand, a co-axial reverse sheath-core two-layer composite filament was prepared, consisting of a non-conductive core layer constituted of the above-mentioned non-conductive polymer A, and a conductive sheath layer constituted of the above-mentioned conductive polymer B, wherein the volume ratio of the sheath to the core was adjusted to 15/85, as a comparative filament No. 2.

Furthermore, a side-by-side two-layer composite filament was prepared, consisting of a non-conductive layer constituted of the above-mentioned non-conductive polymer A, and a conductive layer constituted of the above-mentioned conductive polymer B, wherein the non-conductive layer partially encapsulated the conductive layer, and the volume ratio of the non-conductive layer to the conductive layer was adjusted to 90/10, as a comparative filament No. 3.

The physical properties of the above-obtained comparative conductive filamentary yarns were measured to obtain the results shown in Table 4.

TABLE 4

| | Physical properties of electrically conductive comparative filamentary yarns | | |
|---|---|---|---|
| Comparative Filament No. | No. 1 | No. 2 | No. 3 |
| Component type | co-axial core/middle/sheath | co-axial reverse sheath-core | encapsulated side-by-side |
| Fineness | 24.2 D(3F) | 25.3 D(3F) | 25.4 D(3F) |
| Strength | 3.0 g/d | 2.0 g/d | 3.0 g/d |
| Elongation | 59% | 32% | 52% |
| Specific electrical resistivity | $36 \times 10^4$ Ω-cm | 82 Ω-cm | 260 Ω-cm |

The obtained co-axial core-middle-sheath type filament had insufficient surface electrical conductivity to use as control garments for clean rooms or carpets for computer rooms.

In the preparation of the coaxial reverse sheath-core type filament, carbon black fell off so much that the production apparatus was extensively stained, and the filament could not be seen with the naked eye, making preparation very difficult.

In the preparation of the encapsulated side-by-side conjugate type filament, it was difficult to make a constant composite form of the filament, and the filament was apt to curve just below the spinneret. The forming properties were poor.

EXAMPLE 4

The above-obtained filamentary conductive yarn of Sample No. 3 or Sample No. 4 in Example 2 was plytwisted at 240 t/m with 50 denier 24 filament polyester filamentary yarn. With this plytwisted conductive yarn, a herringbone woven fabric was made. This fabric had a 100 denier base yarn constituted of non-textured, continuous filamentary polyester yarn (36 filament), and had 116 ends per inch and 92.5 picks per inch. In this fabric, the conductive yarn ends were spaced apart about 6 mm, and the conductive yarn picks were spaced apart 6 mm.

The surface electrical resistivity of the obtained woven fabrics was measured according to the following method.

A sample was maintained for 24 hours in a controlled room at 20° C. and 20% R.H., and two electrodes of metallic cylinder were placed on the sample 6 cm apart. At an atmosphere of 20° C. and 20% R.H., a direct current of 100 volts was applied to the electrode and the electrical resistivity was measured, in two instances comprising the electrode placed apart in the warp direction and apart in the weft direction.

The obtained fabrics were repeatedly laundered in a washing machine with water 50 times. The laundered fabrics were tested using the above-mentioned method.

TABLE 5

| | Surface electrical resistivity of woven fabrics of this invention | | | |
|---|---|---|---|---|
| | Sample No. 3 | | Sample No. 4 | |
| | warp | weft | warp | weft |
| | Ω | Ω | Ω | Ω |
| before laundry | $1.6 \times 10^7$ | $2.7 \times 10^7$ | $5.3 \times 10^7$ | $8.2 \times 10^7$ |
| | Ω | Ω | Ω | Ω |
| after laundry | $2.4 \times 10^7$ | $4.0 \times 10^7$ | $6.1 \times 10^7$ | $9.5 \times 10^7$ |

EXAMPLE 5

The above-obtained filamentary conductive yarns of Sample No. 1 or Sample No. 2 in the Example 1, were incorporated into three textured continuous nylon-6 yarns of 1300 denier, 80 filaments for carpet, at the yarn manufacturing step, and plytwisted 40 t/m to a face yarn of 3925 denier.

Using the above-obtained face yarn, loop carpet having level loop pile construction with a height of 10 mm, gauge of 1/10 and 8 stitch of an inch, was made. And, this carpet was backed with styrene-butadiene-copolymer latex containing 0.2% by the weight of carbonized fibers.

This carpet was made easily, without any trouble.

The surface electrical resistivity and the electrostatic charge on the body of the obtained loop carpets were measured according to the following method.

Surface Electrical Resistivity:

A sample 90 cm square was maintained for 24 hours in a controlled room at 20° C. and 20% R.H., and two electrodes of a metallic cylinder having a weight of 2 kg and a diameter of 60 cm, were placed on the sample 15 cm apart. At an atmosphere of 20° C. and 20% R.H., a direct current of 100 volts was applied to the electrode and the electrical resistivity was measured, in four instances comprising the electrode placed apart in the warp direction, in the weft direction, in the bias direction, and in the other bias direction, respectively. The average of the measured resistivity was calculated.

Electro-static charge in body:

A sample 90 cm square dried in the above-mentioned controlled room, and the electro-static charge on the body of the sample was measured according to the stroll method of the carpet test as mentioned in Japanese Industrial Standard No. L-1021.

TABLE 6

| | Electrical Conductivity of Carpets of this invention | |
|---|---|---|
| | Sample No. 1 | Sample No. 2 |
| Surface electrical resistivity | $3.0 \times 10^7$ Ω | $4.1 \times 10^7$ Ω |
| Electrostatic charge on body | −0.4 KV | −0.4 KV |

As will be apparent from the results shown in Table 6, the carpets made of the conductive filament of this invention had excellent electrical conductive properties.

EXAMPLE 6

The above-obtained filamentary conductive yarn of Sample No. 5 in example 3 was used for the weft yarn, and a nylon-6 monofilament yarn of 10 denier, 1 filament was used for the warp yarn, and then, a mesh screen of 185-mesh was made.

The surface electrical resistivity and electrostatic charge on the obtained mesh screen were measured according to the following method.

Surface Electrical Resistivity:

A sample was placed on an insulated pad, and two-electrodes of a metallic cylinder were placed on the sample 5 cm apart, in the weft direction. At an atmosphere of 20° C. and 65% R.H., a direct current of 100 volts was applied to the electrode and the electrical resistivity was measured.

Electro-static charge on screen:

A sample and an assistant fabric (a plain cotton fabric) was maintained for 24 hours in a controlled room at 20° C., and 30% R.H. and, the sample and the assistant fabric were fitted on the rotary static tester of the Kyodai-Kaken method. The electrostatic charge of the sample was measured, after the rotor was rotated at a speed of 400 r.p.m. for 60 seconds at atmosphere of 20° C., and 30% R.H.

TABLE 7

| | Electrical Conductivity of Mesh Screen of this invention | |
|---|---|---|
| | Sample No. 5 | Sample No. 6 |
| Surface electrical resistivity | $5.3 \times 10^5$ Ω | $8.2 \times 10^5$ Ω |
| Electrostatic charge on screen | 0.08 KV | 0.10 KV |

As will be apparent from the results shown in mesh screen comprised the conductive filament of this invention and had excellent electrical conductive properties, especially surface electrical resistivity.

When the mesh screens of this invention were used on video display terminals, the properties of soil resistance, glare resistance and interception of electromagnetic waves were excellent, and the physical properties and durability of this mesh screen were also good.

EXAMPLE 7

Sheath-core three-layer composite filamentary yarns having a partially exposed middle layer were made from a non-conductive polyester component A and a conductive component B as follows; these were the same as used in Example 2.

The non-conductive component was a chipped polyethyleneterephthalate (containing 2.5% by weight of titanium-oxide) having an inherent viscosity of 0.65 as measured in sulfuric acid.

The conductive component B was a chipped nylon-6 the same as the above-mentioned containing 35% by weight of electrically conductive carbon black.

Both components A and B were melted at 290° C. The melts were filtered through a "White Alundum" filter layer, introduced to a spinneret pack, which was the same as that in FIGS. 2 and 3 shown of the drawings, and were composite-spun to prepare sheath-core three-layer composite filaments consisting of a non-conductive core layer, a partially exposed conductive middle layer and a non-conductive sheath layer.

In these filaments, the volume ratio of the core/middle/sheath layers was adjusted to the cross-sectional area ratios of these layers that are shown in Tables 8 and 9 which follow. In the above spinneret, the central angle in the closed portion was changed in order to achieve the intended exposure area of the conductive layer.

The resulting undrawn spun filaments were wound up at a speed of 900 m/min. Subsequently the spun filaments were heatdrawn at a temperature of 155° C. with a draw ratio of 3.45.

The composite structure of the resulting drawn composite filaments, and the properties of the drawn filamentary yarns, are shown in Tables 8 and 9 where Sample D is the same sample described at Example 3 of this specification.

The specific electrical resistivity was determined according to the method described in this specification.

The yarn forming properties were determined whether the above-mentioned spinning and drawing steps were carried out easily or not.

Further, the yarn crimping properties were determined according to the crimp level of the filamentary yarn.

With the above-obtained conductive yarns, woven fabrics were made and measured in the same manner as in Example 4 herein.

That is, one of the above-obtained conductive yarns and one of the non-conductive polyester filamentary yarns of 50 denier 24 filaments were plytwisted at 240 t/m, and the resulting plytwisted conductive yarn, and a 100 denier base yarn constituted of non-textured continuous filamentary polyester yarn (36 filaments), were made into herringbone-weave fabrics, which had 116 ends per inch and 92.5 picks per inch. In these fabrics, the plytwisted conductive yarn ends were spaced apart about 8 mm, and the conductive yarn picks were spaced apart about 6 mm.

The resulting fabrics were laundered in a washing machine with water, repeated 50 times.

The surface electrical resistivity of the resulting woven fabrics was measured according to the following method, and the results are shown in Tables 8 and 9.

A sample was maintained for 24 hours in a controlled room at 20° C. and 20% R.H., and two electrodes of metallic cylinder were placed on the sample 6 cm apart. In an atmosphere of 20° C. and 20% R.H. a direct current of 100 volts was applied to the electrodes and the electrical resistivity of the sample was measured in two instances with the electrodes placed apart in the warp direction and placed apart in the weft direction.

Fibrillation occurring during laundering was determined according to the level of fibrils on laundered fabrics. The results are reported in the following tables.

TABLE 8

| | Sample A (comparative) | Sample B (comparative) | Sample C | Sample D | Sample E | Sample F (comparative) |
|---|---|---|---|---|---|---|
| | | | Properties of conductive yarns | | | |
| Component ratio of core/middle/sheath | 25/15/60 (eccentric) | 25/15/60 | 25/15/60 | 25/15/60 | 25/15/60 | 25/15/60 |
| Exposure of conductive middle layer | 0% | 10% | 20% | 35% | 45% | 55% |
| Fineness | 20.5 D(3F) | 20.0 D(3F) | 20.3 D(3F) | 20.2 D(3F) | 21.0 D(3F) | 20.7 D(3F) |
| Strength | 3.2 g/d | 2.6 g/d | 2.9 g/d | 2.7 g/d | 2.6 g/d | 2.8 g/d |
| Elongation | 46% | 45% | 44% | 44% | 47% | 48% |
| Specific electrical resistivity | $1.3 \times 10^3$ Ω-cm | $7.9 \times 10^2$ Ω-cm | $5.3 \times 10^2$ Ω-cm | $4.9 \times 10^2$ Ω-cm | $2.4 \times 10^2$ Ω-cm | $1.5 \times 10^2$ Ω-cm |
| Yarn forming properties | good | good | good | good | good | poor |
| | | | Surface electrical resistivity of woven fabrics | | | |
| before laundering (warp) | $4.0 \times 10^{10}$ Ω | $1.5 \times 10^9$ Ω | $3.2 \times 10^7$ Ω | $1.6 \times 10^7$ Ω | $1.5 \times 10^7$ Ω | $3.8 \times 10^7$ Ω |
| before laundering (weft) | $3.2 \times 10^{10}$ Ω | $4.5 \times 10^9$ Ω | $3.8 \times 10^7$ Ω | $2.7 \times 10^7$ Ω | $6.9 \times 10^6$ Ω | $1.2 \times 10^7$ Ω |
| after laundering (warp) | $4.7 \times 10^{11}$ Ω | $1.7 \times 10^9$ Ω | $4.2 \times 10^7$ Ω | $2.4 \times 10^7$ Ω | $1.9 \times 10^7$ Ω | $7.0 \times 10^{10}$ Ω |
| after laundering (weft) | $4.6 \times 10^{11}$ Ω | $5.2 \times 10^9$ Ω | $7.0 \times 10^7$ Ω | $4.0 \times 10^7$ Ω | $2.2 \times 10^7$ Ω | $7.0 \times 10^{11}$ Ω |
| fibrillation during laundering | none | none | none | none | none | many |

TABLE 9

| | Sample G (comparative) | Sample H (comparative) | Sample I | Sample D | Sample J | Sample K (comparative) |
|---|---|---|---|---|---|---|
| | | Properties of conductive yarns | | | | |
| Component ratio of core/middle/sheath | 0/15/85 (two layer) | 5/15/80 | 10/15/75 | 25/15/60 | 50/15/35 | 60/15/25 |
| Exposure area of conductive layer | 35% | 35% | 35% | 35% | 35% | 35% (average) |
| Fineness | 20.2 D(3F) | 20.5 D(3F) | 21.0 D(3F) | 20.2 D(3F) | 20.4 D(3F) | 20.0 D(3F) |
| Strength | 3.0 g/d | 2.9 g/d | 2.8 g/d | 2.7 g/d | 2.8 g/d | 3.2 g/d |
| Elongation | 52% | 48% | 42% | 44% | 43% | 40% |
| Specific electrical resistivity | $2.6 \times 10^2$ Ω-cm | $2.5 \times 10^2$ Ω-cm | $4.4 \times 10^2$ Ω-cm | $4.9 \times 10^2$ Ω-cm | $3.5 \times 10^2$ Ω-cm | $1.4 \times 10^3$ Ω-cm |
| Yarn forming properties | poor (yarn bending) | somewhat poor | good | good | good (poor constancy) (of yarn structure) | poor |
| Yarn crimping properties | much crimping | substantial crimping | little crimping | little crimping | no crimping | no crimping |
| | | Surface electrical resistivity of woven fabrics | | | | |
| before laundering (warp) | $3.2 \times 10^7$ Ω | $3.0 \times 10^7$ Ω | $1.3 \times 10^7$ Ω | $1.6 \times 10^7$ Ω | $1.7 \times 10^7$ Ω | $1.2 \times 10^7$ Ω |
| before laundering (weft) | $5.3 \times 10^7$ Ω | $3.8 \times 10^7$ Ω | $5.8 \times 10^7$ Ω | $2.7 \times 10^7$ Ω | $3.3 \times 10^7$ Ω | $2.4 \times 10^7$ Ω |
| after laundering (warp) | *$1.2 \times 10^{10}$ Ω | *$20 \times 10^9$ Ω | $5.5 \times 10^7$ Ω | $2.4 \times 10^7$ Ω | $2.6 \times 10^7$ Ω | $1.1 \times 10^8$ Ω |
| after laundering (weft) | *$3.0 \times 10^{10}$ Ω | *$2.5 \times 10^9$ Ω | $7.2 \times 10^7$ Ω | $4.0 \times 10^7$ Ω | $3.8 \times 10^7$ Ω | $8.4 \times 10^7$ Ω |

*because of fribillation

As will be apparent from the results shown in Tables 8 and 9 a three-layer sheath-core composite filament having 20 to 45 percent of exposure area of the conductive middle layer, and having 10 to 50 percent of the filament cross-sectional area of the core layer, has good properties for textile articles needing high surface electrical conductivity, especially for garments.

On the other hand, for a sufficiently high level of surface electrical resistivity in woven fabrics, the three-layer composite filament needs at least 20% of the exposure of the conductive middle layer, and to achieve little fibrillation with good yarn forming properties, said filament should have at most 45% of exposure area of the conductive middle layer.

In the three-layer composite filament, at least 10% of the core cross-section is needed for good yarn forming properties and small yarn crimping and at most 50% of the core cross-sectional area should be present for providing a constantly composite structure, particularly a constant exposure percentage of the conductive layer.

Therefore, to provide a highly surface electrically conductive composite filament which is industrially manufactured the three-layer sheath-core composite filament needs to have 20 to 45% of the conductive layer exposed and 10 to 50% of core cross-sectional percentage. This is most suitable for high surface electrical conductivity, good forming and handling properties, good durability during use and so on.

We claim:

1. A highly electrically conductive composite filament of the sheath-core type, comprising core and sheath layers each constituting an electrically non-conductive thermoplastic synthetic polymer and a middle layer between the core and sheath layers, said middle layer constituting an electrically conductive thermoplastic synthetic polymer including 15 to 50 percent by weight of electrically conductive carbon black, said core layer comprising 10–50 percent of the total filament cross-sectional area, said middle layer surrounding the overall periphery of said core layer, and said sheath layer partially surrounding the outer periphery of said middle layer, 20 –45 percent of said middle layer being exposed on the filament surface.

2. A highly electrically conductive filament as defined in claim 1, wherein the polymer constituting the core and sheath layers is a polyamide.

3. A highly electrically conductive filament as defined in claim 1, wherein the polymer constituting the core and sheath layers is a polyester.

4. A highly electrically conductive filament as defined in claim 1, wherein the polymer constituting the middle layer is a polyamide.

5. A highly electrically conductive filament as defined in claim 2, wherein the polymer constituting the middle layer is a polyamide.

6. A highly electrically conductive filament as defined in claim 3, wherein the polymer constituting the middle layer is a polyamide.

7. A highly electrically conductive filament as defined in claim 1, wherein the exposure area of the conductive middle layer is 30 to 40 percent.

8. A highly electrically conductive filament as defined in claim 1, wherein the middle layer comprises 2 to 30 percent of the filament cross-sectional area.

9. A highly electrically conductive filament as defined in claim 1, wherein the cross-sectional area ratio of the core layer to the sheath layer is at most 65/35.

10. A highly electrically conductive filament as defined in claim 1, wherein the core layer comprises 20 to 45 percent of the filament cross-sectional area.

11. A highly electrically conductive filament as defined in claim 1, wherein the middle layer includes 30 to 40 percent by weight of electrically conductive carbon black, and comprises 5 to 25 percent of the filament cross-sectional area, and the core layer comprises 15 to 50 percent of the filament cross-sectional areas.

* * * * *

UNITED STATES PATENT AND TRADEMARK OFFICE

CERTIFICATE OF CORRECTION

PATENT NO. : 4,756,969

DATED : July 12, 1988

INVENTOR(S) : Toshiyuki Takeda

It is certified that error appears in the above-identified patent and that said Letters Patent is hereby corrected as shown below:

Column 4, line 10 reads "The composite spinneret shown in FIGS. 2 and com-" should read "The composite spinneret shown in FIGS. 2 and 3 com-"

Column 4, line 17 reads "into outside feed holes (11 and 12 of the upper part (1)" should read "into outside feed holes (11 and 12) of the upper part (1)".

Column 10, Table 7, First Paragraph line 1 reads "As will be apparent from the results shown in mesh" should read "As will be apparent from the results shown in Table 7, the mesh".

Signed and Sealed this

First Day of August, 1989

*Attest:*

*Attesting Officer*

DONALD J. QUIGG

*Commissioner of Patents and Trademarks*